United States Patent [19]

Walter

[11] 4,043,409

[45] Aug. 23, 1977

[54] DRILL STEEL FOR DEEP DRILL HAMMERS

[76] Inventor: Hans-Philipp Walter, Fabrikant, deutscher Staatsangehoriger, Neissestrasse 1 D-3570, Stadt Allendorf 1, Germany

[21] Appl. No.: 669,119

[22] Filed: Mar. 22, 1976

[30] Foreign Application Priority Data

Mar. 22, 1975 Germany ..... 2512784

[51] Int. Cl.[2] ..... E21B 17/00; E21C 15/00

[52] U.S. Cl. ..... 175/321; 175/414; 175/422

[58] Field of Search ..... 175/321, 320, 422; 173/139

[56] References Cited

U.S. PATENT DOCUMENTS

| | | | |
|---|---|---|---|
| 2,097,030 | 10/1937 | Killgore | 175/419 |
| 2,595,962 | 5/1952 | Letts | 175/419 |
| 2,776,819 | 1/1957 | Brown | 175/419 |
| 2,802,642 | 8/1957 | Feucht | 175/419 |

FOREIGN PATENT DOCUMENTS

| | | | |
|---|---|---|---|
| 964,311 | 5/1957 | Germany | 175/321 |

*Primary Examiner*—James A. Leppink
*Attorney, Agent, or Firm*—Fred Philpitt

[57] ABSTRACT

The shaft of a drill steel for down-hole drills having a longitudinally grooved outside is detachably connected to a bore crown widened out towards the working surface and fitted with flush bores, cavities and hard metal inserts. The bore crown is larger in diameter than the drill steel shaft and is interchangeably secured to it. Form-locking companion parts may be axially and/or tangentially cushioned by elastic material, e.g. by resilient pads located under stress between the lower shaft end and an inner wear bit face. A central passage in said shaft is continued through a central resilient pad that can be made up of two integrally joined parts having different mechanical properties. Preferably, shaft and wear bit have matching disharmonic polygonal profiles. Fastening ring and stop means for the detachable yet secure connection of shaft and wear bit are preferred to use a thread of symmetrical, rounded thread-pitch turning in the same direction as the down-hole drill. A divided fastening or retainer ring facilitates the fitting of the drill steel.

33 Claims, 15 Drawing Figures

Figure 1:
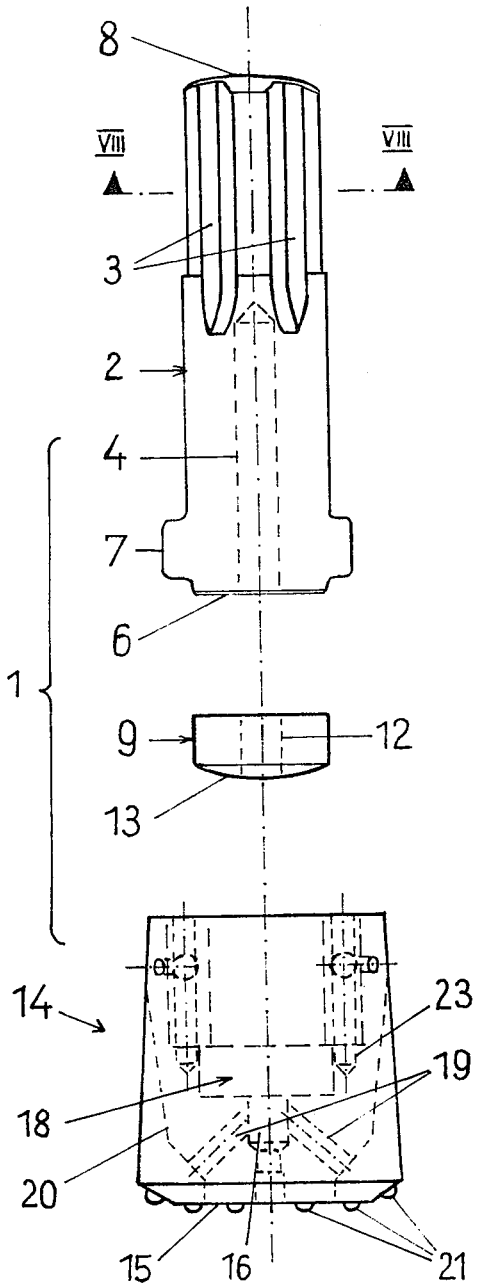

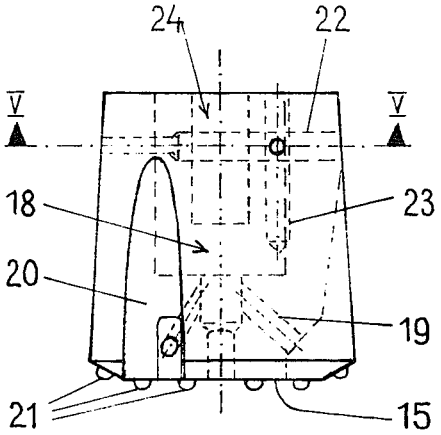
FIG. 3
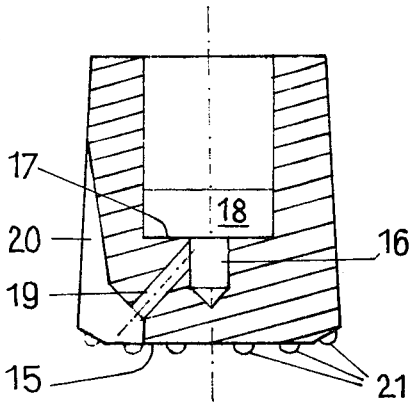
FIG. 4
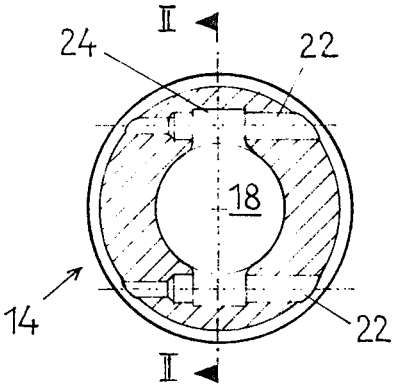
FIG. 5
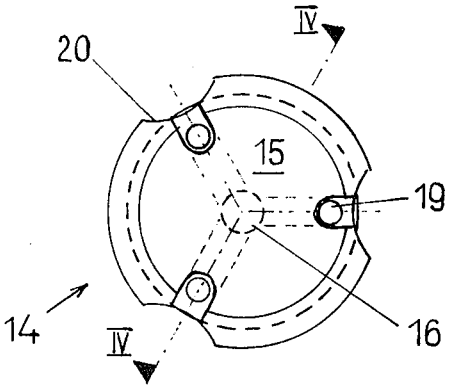
FIG. 6
FIG. 7
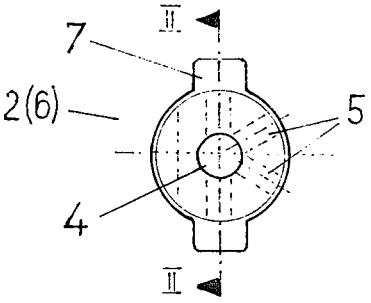
FIG. 8
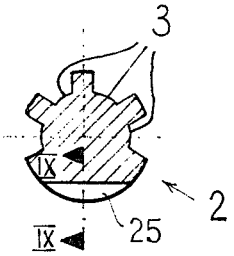
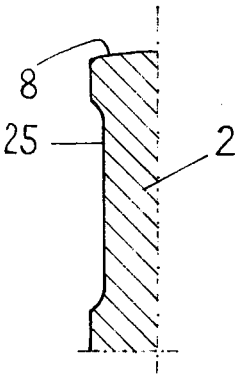
FIG. 9

DRILL STEEL FOR DEEP DRILL HAMMERS

DESCRIPTION

The present invention concerns a drill steel for deep drill hammers with a bore crown which widens out in the direction of the working surface and fitted with flush bores, cavities and hard metal inserts, especially X cutting edges, ribs, buttons and the like, and having a shaft, with longitudinal grooves on the outside, the cross-section of which is smaller in comparison with the bore crown, the bore crown being in the form of a wear bit interchangeably connected to the shaft.

Deep drill hammers for deep drilling are inserted in the borehole and operated by blows and, in some cases, by rotating them in the immediate vicinity of the bottom of the borehole. High pressure drive, with a large output of compressed air, is used for this purpose. Suitable equipment is described, for example, in DT-PS Nos. 1,000,310, 1,035,075 and 1,408,666. The usual types of drilling equipment have mobile mountings, in some cases with a revolving drive, and make use of pistons, the striking force of which is transmitted direct to the drill steel. This latter usually consists of a hollow component, the size of which increases conically downwards, having outlet passages for cooling the tool, which is also known as a bore crown, and for flushing out the drillings, which pass upwards along outer longitudinal grooves formed in the drill steel and in the connected shaft and can be extracted on the surface by suction.

It is not only when working in very hard and abrasive or cleft rock that the severely stressed drill steels suffer an exceptionally high rate of wear, the result of which is that, after a relatively short service life, even those drill steels fitted with diamond or hard metal inserts of many different kinds, for example, with rollers, X or cross-type cutting edges, buttons, etc., have to be replaced. This necessitates the withdrawal of the drill rod from the borehole, followed by its reinsertion, so that the interruption of the drilling progress cannot be avoided.

Drill steels have already been proposed, the lower part of which is in the form of a wear bit and is interchangeably joined to the shaft, for example, by means of a screw thread (DT-OS No. 1,533,631) or of a key joint (DT-GM No. 1,922,505). In actual practice, however, it has been found that such rigid mountings do not stand up for long to the forces acting on them. Especially if the striking frequency is high, the joint between the shaft of the steel and the bore crown is completely destroyed within a short time.

The aim of the invention is, while avoiding the disadvantages of the present state of the technology, to produce a drill steel which will stand up to high stresses for long periods and will make it possible, using simple and economical methods, to keep stoppage times short and the cost of replacing the steel low.

In the case of a drill steel of the type referred to at the outset, the invention envisages that the wear bit is flexibly and resiliently connected to the shaft. Thus, the drill steel is made up of the shaft, which acts as an intermediate anvil, and the cushioned wear bit to form the actual drilling tool, whereby wear is significantly reduced. The reactive forces occurring during rotary blow drilling are not, as is the case with conventional methods, transmitted by a rigid tool to the hammer and back to the rock, which gives rise to repeated recoil effects and a corresponding strain on the implements. Instead, such shocks are attenuated or eliminated by the cushioning without the loss of any significant amount of striking energy. As a result, tool and shaft are conserved. When wear has occurred, the cushioned wear bit can be quickly and effortlessly replaced with the aid of a simple device, while the intermediate anvil, with its much longer service life, does not need to be replaced until later. In contrast, it was usually necessary, at the cost of a great deal of time and effort, either to unscrew the worn drill steel from the shaft and to screw on a new bit or else, with much exertion, to detach the wear bit from the joint, which had been violently distorted or destroyed.

In one version of the invention, a resilient pad is located between the end of the shaft and an inner front face of the wear bit in the form, especially, of a cylindrical block of, for example, polyurethane, special rubber or something similar, with or without spring loading. Such pads are easy to produce, simple to fit and thoroughly advantageous in operation. Tests have shown that the service life of pre-stressed resilient pads is very long and at least equal to that of the wear bit.

A futher development of the invention provides for the resilient pad and the wear bit to be at least partly penetrated by a central passage. This makes it possible to bring the flushing agent directly to the bottom of the borehole, leading to a marked increase in the rate of advance of the borehole. In the wear bit, close to its front face, the central passage may end in a blind hole and be continued radially by, for example, three skewed ports running at regular sector angles, which should preferably open out into longitudinal chipway grooves in the wear bit. In the same way, a central passage can be formed in the shaft in the shape of a blind hole ending about halfway along it and turning into skewed ports leading to the outer longitudinal grooves in the shaft, which should preferably taper towards the middle of the shaft. These measures facilitate the passage of the flushing agent through the drill steel and upwards along the outside thereof, carrying the drillings with it.

In accordance with a further specialised version of the invention, provision is made for the shaft and wear bit, with the resilient pad located between them, to be connected by fitting the shaft, near its bottom end, with at least two diametrically opposed projections to the rear of which securing pins grip in a form-locking manner and can be secured by longitudinal pins in transverse holes in the wear bit. Such a joint can be equally quickly made and disconnected. The longitudinal pins can be provided with tapered ends which in turn are secured by transverse pins, so that accidental loosening or severance of the joint cannot occur. Because the resilient pad is under tension in the wear bit, a permanent static force is exerted on the connecting pins, which reduces the impact load and thus counteracts any permanent deformation of the joint elements. It is also possible, and the invention provides for this, for at least the longitudinal pins to be conically shaped and secured in corresponding conical transverse holes until such time as these joint elements are undone on the surface for the purpose of replacing the wear bit, a procedure which, with this arrangement, can be carried out particularly easily and quickly.

The resilient pad should preferably be located in a circular chamber in the wear bit, the side wall of which is undercut, concavely curved or provided with at least one annular groove. By means of such a shape, the resilient pad, once it is fitted into the wear bit with the aid of a suitable device, is form-locked therein and, in addition, space is available for the material of the resilient pad to yield if, at the moment of impact of the hammer, an axial compression occurs.

The invention also provides for the resilient pad to consist of at least two parts of different density and/or elasticity and integrally joined, especially a harder core surrounded on all sides by a softer jacket. It is especially advantageous if the resilient pad has at least one part of closed cell foam and at least one front face which is convexly curved and/or chamfered at its circumference. While the resilient pad, in its simplest form, consists of a largely cylindrical flat ring, it is preferable for it to have curves at both front faces, which have the effect of damping movement. Its central passage can, for example, be shaped like a barrel, so that, in conditions of maximum axial compression, a cylindrical through hole still exists. A multi-layer construction contributes to ensuring maximum useful life of the resilient pad, in spite of high alternating stresses. It is advisable to fit a flatter stop disc radially to the resilient pad, which lowers the shaft of the drill steel in its extreme position.

In accordance with the invention, the shaft and the wear bit can be detachably connected by a bayonet fixing, so that replacement can be effected quickly and easily whilst maintaining adequate tightness of the joint in operation, especially in those cases where rotating operation of the drill steel results in continuous tightening of the bayonet fixing.

The invention also provides for the shaft to have a peripheral groove in which a fastening ring, preferably split, fitted in the wear bit engages, this ring assuming the function of the above-mentioned longitudinal and transverse pins.

It is an advantage, for securing the drill steel, if, for the purpose of fitting the drill steel, its shaft can be inserted from above into a retainer having on its underside an annular projection or similar stop parts on which a corresponding projection on the shaft bears.

A further advantageous version of the invention provides for shaft and wear bit to be of polygonal cross-section, especially a disharmonic $PC_4$ section, so that, while retaining free axial movement, form-locking combined movement in the direction of rotation is ensured.

Another feature of the invention involves the wear bit having at least one insert, the outer part of which is recessed on its circumference and, by means of resilient packing, is cushioned in a peripheral direction. This ensures adequate damping even with harsh operation.

In a particularly simple version of the invention, the stop disc is made in one piece with the wear bit and the resilient pad is enclosed therein.

In a further version of the invention, there is, to secure the wear bit, a threaded ring on the shaft of the drill steel for securing the fastening ring axially, this threaded ring having, for the specific purpose of fitting to a projection on the wear bit, a stop collar which should preferably be provided with wrench flats. This ensures that the free rotatability of the catch ring is not interfered with. Furthermore, the strain on the thread is reduced and there is an exceptionally large bearing surface.

An important feature of a drill steel in accordance with the invention provides that the wear bit be formed in two parts, an upper ring section being detachably connected with a lower foot by means of safe securing elements, e.g., by means of socket bolts with force-locking or form-locking safety mechanism. This simplifies fixing and, in certain circumstances, makes replacement even cheaper, when the foot is used up. The ring section can overlap the fastening ring and may have supporting parts on the foot, thus ensuring satisfactory power transmission. One particular version is advantageous in the case of rotating following, in which the foot is indented with the ring head, preferably by means of alternating steps on the inner and/or outer periphery. These steps can run in the same direction, or in the same sense of rotation, either flat or wedge-shaped, as the noses or shoulders on the insert and wear bit. Preferably, the steps should be similarly formed and arranged at regular angular or peripheral intervals.

Yet another feature of the invention is that it provides for the shaft and wear bit to be made of different materials, for example, on the one hand, of chisel steel with a high resistance to impact stresses, and on the other hand of an abrasion-resistant alloy such as X155CrVMo12 1. Such a combination of materials has the advantage that the full force of the deep drill hammer can be transmitted, and yet very long edge lives of the drill steel can be achieved. The useful life can be still further improved to a considerable extent if, in accordance with the invention, at least parts of the drill steel are coated with boron carbide, of which a surface layer of, for example, 0.3 to 0.4 mm in depth, has a Vickers hardness in the range above some 1800 HV.

A further important version of the invention, for which separate protection is claimed, envisages, for a drill steel consisting of a shaft and wear bit interchangeably fitted thereto, that, for the detachable securing of the wear bit to the shaft of the steel drill, the bottom end of the latter has a projection which is engaged by a radially divided fastening ring, with a stop collar, which is screwed into the wear bit. In comparison with the versions previously described, this represents a marked simplification of the means of securing the wear bit. As a result, the design and manufacture of the bore crown require much less effort; only a few parts are necessary, and fixing and detachment of the wear bit to and from the shaft of the bore crown can be effected considerably more quickly.

In this particular case, it is an advantage if the thread for securing the fastening ring in the wear bit turns in the same direction as the hammer drive and possesses a symmetrical, rounded thread-pitch. This does away with the necessity to secure the fastening, because the hammer drive itself screws the fastening ring as far as it will go into the wear bit which, at the same time, holds the latter together, and repeats this screwing in process, or tightens it, with each operating cycle. In addition, the form of thread makes it possible, using a standard type of uncoupling device, to disconnect easily and, above all, quickly, in cases of necessity, the joint against the direction of rotation of the hammer drive, especially when replacement of the wear bit of the drill steel is required.

It is also advantageous if the bottom end of the shaft of the drill steel engages in a form-locking manner in the inner front face of the wear bit, either directly or with the interposition of a resilient pad, in such a way that the whole of the impact energy supplied is transmitted to a wide area, and the specific load on the end of the shaft of the drill steel and on the wear bit remains relatively small.

For assembling and dismantling the drill steel in accordance with the invention, it is an advantage if at least all those parts, the external diameter of which is at least equal to that of the drill hammer, are provided on the outside with a fluted profile, and in particular the retainer for the drill steel head and the wear bit. Thanks to this measure, breaking and gripping devices, such as are available conventionally for the drill rod, can be used for rapid dismantling and assembly of the drill hammer. In addition, the fluted profile permits improved flushing of the drillings out of the borehole.

Figure 2:
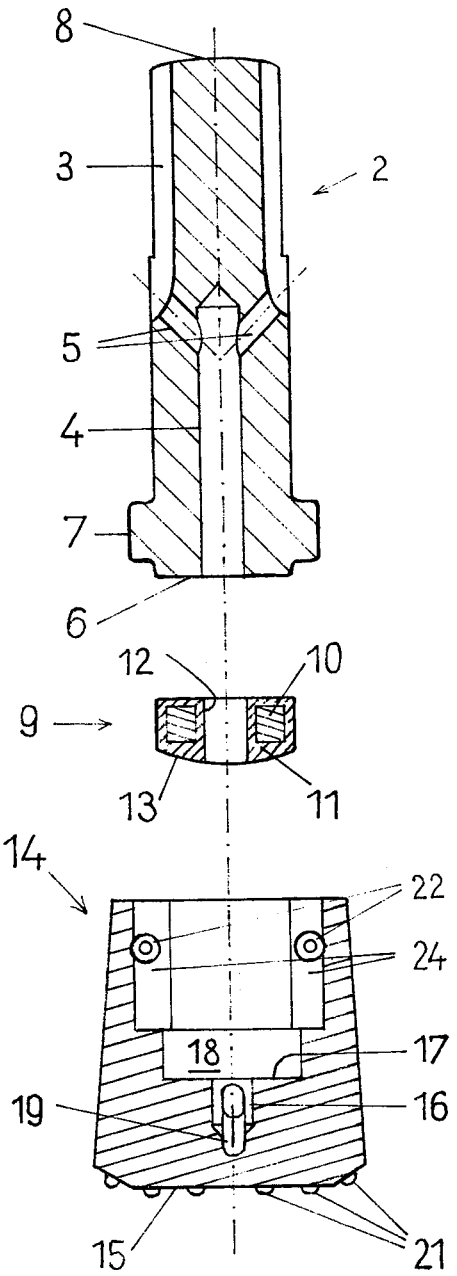
Figure 10:
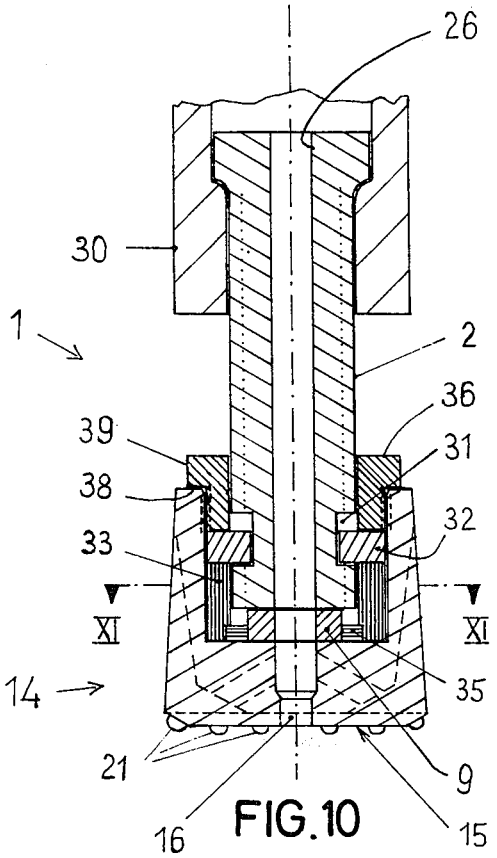
Figure 12:
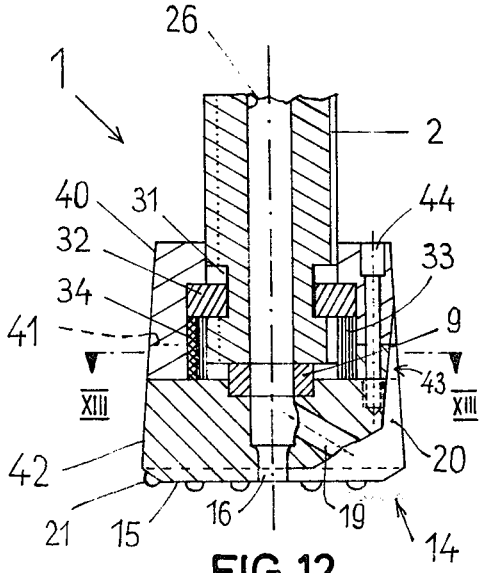
Figure 11:
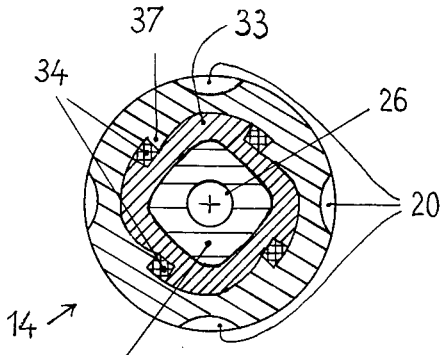
Figure 13:
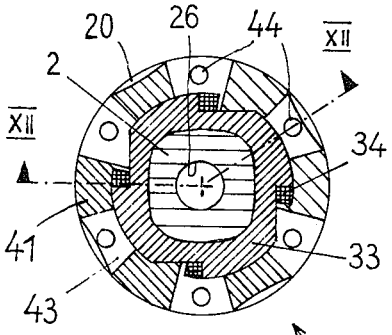
Figure 14:
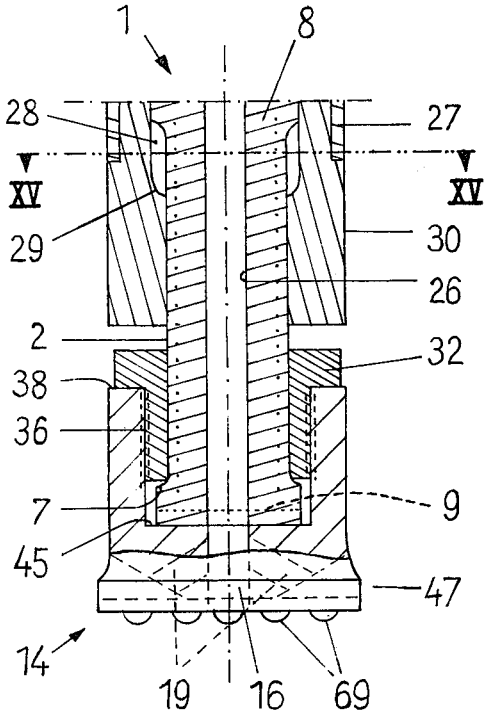
Figure 15:
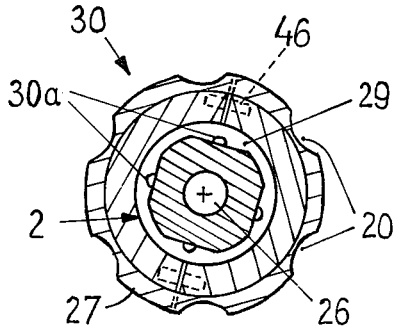

Additional features, details and advantages of the invention can be seen from the following description of examples of various versions, with the aid of the drawing, in which are shown:

FIG. 1 an exploded side view of a drill steel consisting, in accordance with the invention, of shaft, resilient pad and wear bit, FIG. 2 an exploded sectional view of the components of a drill steel in accordance with the invention, with sections corresponding to the lines II—II in FIGS. 5 and 7, FIG. 3 a side view, rotated through 90° as compared with FIG. 1, of the wear bit in accordance with the invention, FIG. 4 an axial sectional view of the wear bit corresponding to the line IV—IV in FIG. 6, FIG. 5 a section through the wear bit corresponding to the line V—V in FIG. 3, FIG. 6 a view from below of the wear bit in FIG. 3, FIG. 7 a view from below of the shaft of a drill steel as in FIG. 1, FIG. 8 a section through the shaft corresponding to the line VIII—VIII in FIG. 1, FIG. 9 a longitudinal section through the shaft corresponding to the line IX—IX in FIG. 8, FIG. 10 an axial section through a drill steel in accordance with the invention, FIG. 11 a section corresponding to the line XI—XI in FIG. 10, FIG. 12 an axial section through another version of a drill steel in accordance with the invention, corresponding to the line XII—XII in FIG. 13, FIG. 13 a section corresponding to the line XIII—XIII in FIG. 12, FIG. 14 an axial section through a drill steel in accordance with another version of the invention and FIG. 15 a section corresponding to the line XV—XV in FIG. 14.

A drill steel 1 in accordance with the invention consists of s shaft 2, a resilient pad 9 and a bore crown in the form of a wear bit 14, which is interchangeably connected to the shaft 2. For the sake of clarity, these components are shown in exploded form in FIGS. 1 and 2.

The shaft 2 has longitudinal grooves 3 on its outside, which extend approximately from the axial centre of the shaft 2 as far as its upper or anvil end 8. A central passage 4 extends from the bottom end 6 approximately as far as the longitudinal centre of the shaft 2, and forks near its end into skewed holes 5 which terminate in the outer longitudinal grooves 3. Near its bottom end 6, the shaft 2 has lateral projections in the form of shoulders 7, by means of which it can be secured in the wear bit 14. In the version illustrated, two such projections, located diametrically opposite one another, are provided, but it is also possible to have a larger number of projections with peripheral and axial displacement.

The resilient pad 9 consists preferably of a harder core 10 surrounded integrally by a softer jacket 11. It has a through axial opening or central passage 12 which, unlike the version illustrated (FIGS. 1 and 2), can be roughly barrel-shaped, so that it assumes a largely cylindrical shape only when subjected to axial compression. The resilient pad 9 can be curved at one end face 13 or at both end faces, whereby it is also possible for the curvature to be such that a cylindrical segment is present all around the inner and/or outer edge.

The shape of the wear bit 14 is slightly conical, thickening towards the bottom. Towards the foot or bottom face 15, the wear bit 14 is chamfered at its outer circumference. Hard metal inserts are fitted in the chamfer and in the foot 15 which, in the version illustrated, are in the form of approximately hemispherical buttons 21. In a circumferential direction, the circular body of the wear bit 14 is interrupted on the outside by chipway grooves 20 which run upwards from the bottom face 15 to the outer wall. These chipway grooves 20 are connected via skewed flushing ports 19 to a central passage 16, which terminates above the bottom face 15 as a blind hole. A circular chamber 18 adjoins the top of the central passage 16 for the purpose of receiving the resilient pad 9 which also has a central hole. Above it is a hollow space with lateral recesses 24 which is intended to receive the bottom end 6 of the shaft 2 with the projections 7. Wear bit 14 and shaft 2, with the resilient pad 9 inserted, are detachably connected to one another, pins (not shown) being inserted in transverse holes 22 in the wear bit 14 and secured by means of longitudinal pins (also not shown) inserted in longitudinal holes 23. The pins pass over the projections 7, thereby pressing the shaft 2 against the upper front face of the resilient pad 9, which is located under stress in the circular chamber 18 of the wear bit 14.

The flushing agent can be fed to the assembled drill steel in the deep borehole via the outer longitudinal grooves 3, the skewed holes 5, the central passages 4, 12, 16 and the skewed flushing ports 19. Extraction of the flushing agent and of the drillings takes place via the chipway grooves 20 in the wear bit 14, in the free space between the shaft 2 or the drill rod and the borehole. An indentation 25 in the upper part of the shaft 2 (FIGS. 8 and 9) serve to secure it.

For the sake of clarity, the hard metal inserts, e.g., buttons 21, are omitted from FIG. 6.

While, in the examples illustrated, the wear bit 14 has in each case three chipway grooves 20, connected via three skewed ports 19 with the central passage 16, it is also possible to have skewed ports 19 and chipway grooves 20 in larger numbers (cf. FIG. 11). Generally speaking, it is preferable to have a regular distribution around the circumference, but it may also be desirable and advantageous, as in the case of the skewed holes 5 in the shaft 2 (FIG. 7), to concentrate the skewed flushing ports 19 of the wear bit 14 on one side.

In contrast to the examples of versions described above, it is also possible, in accordance with the invention, to provide for other means of connecting the components of the drill steel 1, provided only that they are — at least in the direction of drive — resistant to torsion and protected against deformation by impact. A certain amount of play in the movement can help the connecting elements, while continuing to function in operation, constantly to change their position slightly, with the result that more even stresses occur and wear is reduced.

An example of this is shown in FIGS. 10 and 11. The drill steel 1 illustrated there is inserted, together with its somewhat enlarged guide head, from above into a retainer 30 which forms the lower seal of the cage of a deep hole drill hammer and has an annular shoulder on which the guide head of the shaft 2 of the drill steel rests in its end position. In this version, the shaft 2 has a cylindrical through hole 26, while it has on the outside a polygonal section of type $PC_4$ (FIG. 11). The lower inside part of the retainer 30 has a corresponding form-locking polygonal section.

The wear bit 14 is detachably fixed to the bottom end of the shaft 2. For this purpose, the shaft 2 has an annular groove 31 in which a fastening ring 31, preferably radially divided, engages, being secured between a polygonal insert 33 and a threaded ring 36, which is also of polygonal section and, preferably, has recesses for inserting a tool. The resilient pad 9, stressed axially, is located in the wear bit 14 below the shaft 2. Connected radially to the resilient pad 9 is a flatter stop disc 35, which limits the pressure travel of the shaft 2 within the guide or fastening ring 32. A stop disc of this kind can also be used with advantage with other versions of drill steels.

FIG. 11 also shows that the guide or fastening ring 32 is stepped on its outer circumference like a ratchet wheel, and that noses 37 are correspondingly fitted to the form-locked inner profile of the wear bit 14. Between these projections and the noses 37, damping insert packings 34 are braced which, in the example illustrated, consist of four parallel wedges, but may also run obliquely and be of different profile. They can be made of the same elastic yielding material as the resilient pad 9, e.g., of polyurethane, special rubber and the like, and they serve the purpose of damping or absorbing the rotary motion of the components of the drill steel and of preventing excessive wear of the inner parts of the bore crown and breaking off of the hard metal parts.

FIGS. 12 and 13 depict parts of a further version of a drill steel 1 in accordance with the invention. This version is similar to the example shown in FIGS. 10 and 11, and for this reason, equivalent elements are designated by the same reference numbers. The shaft 2 of the drill steel, which again is of polygonal section and is fitted with a peripheral groove 31 near its bottom end, is gripped axially by a divided ring 32 which, in this case, is gripped by an upper ring head 40 and axially secured. The upper ring head 40 and a lower foot 42 together constitute the bore crown or the wear bit 14 which has hard metal inserts or buttons 21 on its outer front face 15 and is in general constructed in a similar manner to the example in FIGS. 10 and 11. The shaft 2 of the drill steel and the wear bit 14 are penetrated by a through hole 26 which, in the lower foot 42, takes the form of a central passage 16 and skewed flushing ports 19. In the lower foot 42, the resilient pad 9 is embedded and partly countersunk, so that, instead of a separate stop disc 35 (FIG. 10), the same function of limiting the travel of the shaft 2 of the drill steel is performed by the upper front face of the foot 42. This latter has steps 43 on its periphery which interact with corresponding steps 41 on the upper ring head 40 in a form-locking manner in that these steps, which point alternatively up and down, engage in one another. The connection between parts 41, 42 can, for example, be effected by means of socket bolts 44 secured by force or form-locking and cannot therefore work loose in use. In turn, a stepped insert 33 on the outer circumference ensures that the wear bit 14 moves together in rotation, this insert being cushioned by damping packing in a circumferential direction.

In accordance with the invention, it is also possible to combine the layouts in FIGS. 10 and 12 by, for example, having the threaded ring 36 as the upper ring head 40 and fitted, by means of a screw connection, a bayonet mounting or the like, to the lower foot 42.

FIGS. 14 and 15 depict a variation of a drill steel 1 in accordance with the invention in conjunction with a retainer 30 on a deep drill hammer (not shown), to the outside tube of which the radially divided retainer 30 is fixed. Its halves are bolted together by pins 46 after the head 8 of the drill steel 1, the diameter of which is enlarged in comparison with the shaft 2, has been inserted in the retainer 30. A shoulder 29 in the lower part of the retainer 30, which acts as an anvil stop, limits the travel of the drill steel 1 and of its head 8 in a downward direction. In the padding space 28 between the head 8 of the drill steel and the shoulder 29, elastic yielding material can be inserted to absorb gently the impact, for example, a cushioning ring.

Like the inner lower part of the retainer 30, the shaft 2 of the drill steel 1 is of polygonal section. It is fitted at its bottom end with a shoulder-like projection and is connected either directly or via a resilient pad 9 of elastic yielding material (shown as a dotted line) to the inner front face 45 of the bore crown or of the wear bit 14 in a form-locking manner.

The bore crown 14 is detachably connected to the bottom end of the drill steel 1 by means of a radially divided fastening ring 32. For this purpose, the fastening ring 32 and the bore crown 14 have a thread 36 which turns in the same direction as the hammer drive and, preferably, has symmetrical rounded flanks shaped like a corrugated tube. At its upper stop collar 38, the fastening ring 32 is of polygonal section inside, which grips the shaft 2 of the drill steel in a form-locking manner.

The drill steel 1 has a central passage 26 to which the flushing air openings 16 and 19 in the bore crown 14 are connected, the latter having a widened base 47. As in the case of the versions previously described, the bore crown 14 has at its base and on the chamfered bottom edge of the base 47 rigidly fixed hard metal inserts in the form of buttons 21, which are uniformly distributed, by preference, around the circumference and on the bottom surface.

It will be seen that, in the case of the version illustrated in FIGS. 14 and 15, replacement of a bore crown 14 can be effected particularly simply. Suitable gripping and breaking devices take hold of the outer grooves 20 of the retainer 30, in order to secure them, while the bore crown 14 is screwed off the fastening ring 32 in the opposite direction to the rotation of the hammer drive. The new bore crown 14 is screwed on with equal ease, the two halves of the fastening ring 32 being held together on the shaft 2 of the drill steel above the projection 7 by the threaded connection 36 of the wear bit itself. In operation, the bore crown 14 is automatically screwed tight on to the thread 36 with each operating stroke.

Many more variations and simplifications are to be found within the general concept of the invention. All the features and advantages of the invention originating in the claims, the description and the drawing, including details of design, spatial layout and operating procedures can be of importance, in terms of the invention, both on their own and in the widest variety of combinations.

I claim:

1. A steel drill device for down-hole drills, with a bore crown widened out in the direction of the working surface and fitted with flush bores, cavities and hard metal inserts, especially X cutting edges, ribs and buttons, and having a shaft with longitudinal grooves on the outside, the cross-section of which is smaller in comparison with the bore crown, the bore crown being in the form of a wear bit interchangeably connected to the shaft with flexible cushioning, wherein the latter is a resilient pad located under stress between the end of said shaft and an inner face of said wear bit, and wherein said resilient pad and said wear bit are penetrated at least partly by a central passage.

2. The device according to claim 1, wherein said central passage in said wear bit ends near the front face of the latter in a blind hole and is continued radially through skewed ports running at regular sector angles.

3. The device according to claim 2 wherein said skewed ports open out into longitudinal chipway grooves in said wear bit.

4. The device according to claim 1, wherein a central passage in said shaft is in the form of a blind hole ending about halfway along it and turning into skewed holes leading to said outer longitudinal grooves in said shaft.

5. The device according to claim 4 wherein said outer longitudinal grooves taper towards the middle of said shaft.

6. The device according to claim 1, wherein said shaft, near its lower end, has at least two diametrically opposed projections to the rear of which securing pins grip in a form-locking manner, said shaft being adapted to be secured by means of longitudinal pins in transverse holes in said wear bit.

7. The device according to claim 1, wherein said resilient pad is located in a circular chamber in said wear bit, the side wall of which is shaped to form-lock said resilient pad.

8. The device according to claim 1, wherein said resilient pad consists of at least two integrally joined parts of different density.

9. The device according to claim 1, wherein said resilient pad consists of at least two integrally joined parts of different elasticity.

10. The device according to claim 1, wherein said resilient pad consists of a harder core surrounded on all sides by a softer jacket.

11. The device according to claim 1, wherein said resilient pad has at least one part of closed cell foam.

12. The device according to claim 1, wherein said resilient pad has at least one front face protruding in axial direction.

13. The device according to claim 2, wherein said resilient pad consists of a largely cylindrical flat ring.

14. The device according to claim 1 wherein a flatter stop disc is fitted radially to said resilient pad.

15. The device according to claim 14, wherein said stop disc is made in one piece with said wear bit and said resilient pad is enclosed therein.

16. The device according to claim 1, wherein said shaft and said wear bit are detachably connected by a bayonet fixing.

17. The device according to claim 1, wherein said shaft has a peripheral groove in which a fastening ring fitted in said wear bit engages.

18. A steel drill device for down-hole drills, with a bore crown widened out in the direction of the working surface and fitted with flush bores, cavities and hard metal inserts, especially X cutting edges, ribs and buttons, and having a shaft, with longitudinal grooves on the outside, the cross-section of which is smaller in comparison with the bore crown, the bore crown being in the form of a wear bit interchangeably connected to the shaft with flexible cushioning, wherein said shaft and said wear bit are detachably connected by a fastening ring means engaging a stop means.

19. The device according to claim 18 wherein said shaft and said wear bit are of disharmonic polygonal cross-section.

20. The device according to claim 18, wherein said wear bit has at least one insert, the outer part of which is recessed on its circumference and, by means of resilient packing, is cushioned in a peripheral direction.

21. The device according to claim 18, wherein to secure said wear bit, there is a threaded ring on said shaft for securing said fastening ring means axially.

22. The device according to claim 21, wherein said threaded ring has, for the purpose of fitting to a projection of said wear bit, a stop collar.

23. A steel drill device for down-hole drills, with a bore crown widened out in the direction of the working surface and fitted with flush bores, cavities and hard metal inserts, especially X cutting edges, ribs and buttons, and having a shaft, with longitudinal grooves on the outside, the cross-section of which is smaller in comparison with the bore crown, the bore crown being in the form of a wear bit interchangeably connected to the shaft with flexible cushioning, wherein said wear bit is formed in two parts, an upper ring section being detachably connected with a lower foot by means of safe securing elements, especially by means of a socket bolts with a locking safety mechanism.

24. The device according to claim 23, wherein said upper ring section overlaps a fastening ring and has supporting parts resting on said lower foot.

25. The device according to claim 23, wherein said lower foot is indented with said upper ring section by alternate steps on the periphery.

26. The device according to claim 25, wherein said steps run in the same sense as shoulders on said insert and said wear bit.

27. The device according to claim 25, wherein said steps are of like shape and are at regular angular intervals.

28. A steel drill device for down-hole drills, with a bore crown widened out in the direction of the working surface and fitted with flush bores, cavities and hard metal inserts, especially X cutting edges, ribs and buttons, and having a shaft, with longitudinal grooves on the outside, the cross-section of which is smaller in comparison with the bore crown, the bore crown being in the form of a wear bit interchangeably connected to the shaft with flexible cushioning, wherein, for the detachable securing of said wear bit to said shaft, the bottom end of the latter has a projection which is engaged by a radially divided fastening ring, with a stop collar, which is screwed into said wear bit.

29. The device according to claim 28, wherein the thread for securing said divided fastening ring in said wear bit turns in the same direction as said down-hole drill and possesses a symmetrical, rounded thread-pitch.

30. The device according to claim 28, wherein said bottom end of said shaft engages in a form-locking manner in the inner face of said wear bit.

31. A steel drill device for down-hole drills, with a bore crown widened out in the direction of the working surface and fitted with flush bores, cavities and hard metal inserts, especially X cutting edges, ribs and buttons, and having a shaft, with longitudinal grooves on the outside, the cross-section of which is smaller in comparison with the bore crown, the bore crown being in the form of a wear bit interchangeably connected to the shaft with flexible cushioning, wherein all those parts, the external diameter of which is at least equal to that of said down-hole drill, are provided on the outside with a fluted profile.

32. A steel drill device for down-hole drills, with a bore crown widened out in the direction of the working surface and fitted with flush bores, cavities and hard metal inserts, especially X cutting edges, ribs and buttons, and having a shaft, with longitudinal grooves on the outside, the cross-section of which is smaller in comparison with the bore crown, the bore crown being in the form of a wear bit interchangeably connected to the shaft with flexible cushioning, wherein said shaft and said wear bit are made of different materials, namely on the one hand of chisel steel with a high resistance to impact stresses, and on the other hand of an abrasion-resistant alloy.

33. The device according to claim 32, wherein at least parts of said drill steel are coated with boron carbide, of which a surface layer has a Vickers hardness in the range above 1,800 HV.

* * * * *